United States Patent [19]

Weyker et al.

[11] 4,026,711

[45] May 31, 1977

[54] FLAME RETARDANT FINISH FOR TEXTILES

[75] Inventors: Robert George Weyker, North Plainfield; William Frederick Baitinger, Jr., Hillsborough Township, Somerset County, both of N.J.

[73] Assignee: American Cyanamid Company, Stamford, Conn.

[22] Filed: Nov. 11, 1971

[21] Appl. No.: 197,980

Related U.S. Application Data

[63] Continuation-in-part of Ser. No. 147,566, May 27, 1971, abandoned.

[52] U.S. Cl. ..... 106/15 FP; 8/116 P; 8/183; 8/185; 252/8.1; 260/29.4 R; 427/390 D

[51] Int. Cl.[2] ..... C09D 5/18

[58] Field of Search ..... 260/29.4 R, 606.5 F; 117/136, 137, 139.4; 8/116 P, 183, 185; 252/8.1; 106/15 FP

[56] References Cited

UNITED STATES PATENTS

| | | | |
|---|---|---|---|
| 2,892,803 | 6/1959 | Reeves et al. | 117/136 |
| 3,221,057 | 11/1965 | Gordon et al. | 117/136 |
| 3,236,676 | 2/1966 | Coates | 117/137 |
| 3,644,083 | 2/1972 | Stockel et al. | 117/136 |

*Primary Examiner*—Lorenzo B. Hayes
*Attorney, Agent, or Firm*—H. G. Jackson

[57] ABSTRACT

Stable, aqueous, flame retardant finishes for cellulosic textile materials employing tetrakis(hydroxymethyl)-phosphonium phosphate, tetrakis(hydroxymethyl)-phosphonium carboxylate and urea or a urea-formaldehyde condensate, and, processes employing said finishes are disclosed, together with processes for the preparation of the phosphonium compounds from tris(-hydroxymethyl)phosphines.

6 Claims, 1 Drawing Figure

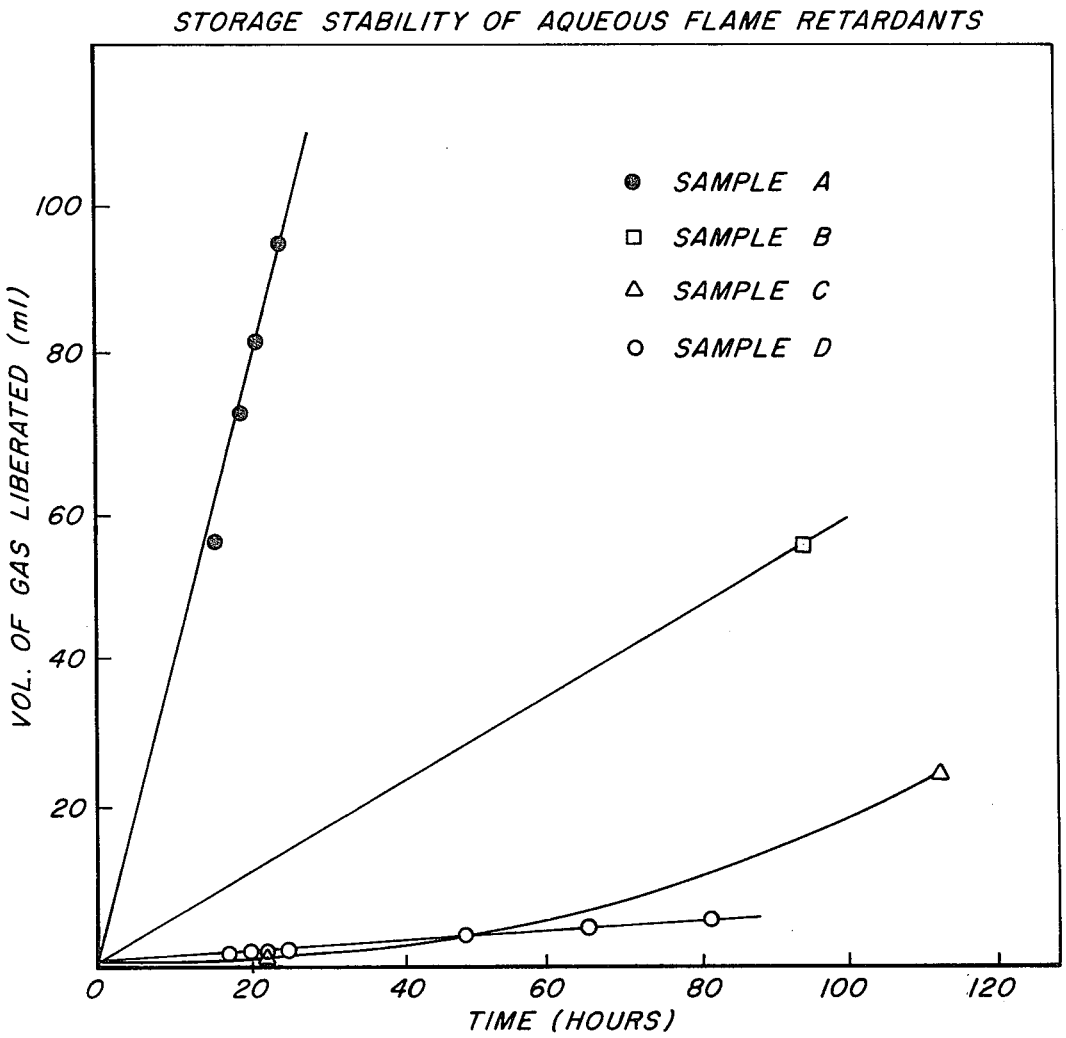
INVENTORS
ROBERT GEORGE WEYKER
WILLIAM FREDERICK BAITINGER JR.
BY Robert P. Raymond

FLAME RETARDANT FINISH FOR TEXTILES

This application is a continuation-in-part of co-pending application Ser. No. 147,566, filed May 27, 1971 now abandoned.

This invention relates to flame retardant finishes for cellulosic textile materials and methods employing said finishes. More particularly, it relates to aqueous flame retardant finishes and processes employing tetrakis(hydroxymethyl)phosphonium phosphate, tetrakis(hydroxymethyl)phosphonium carboxylate, and urea or a urea-formaldehyde condensate. It further relates to processes for preparing the phosphonium compounds from tris(hydroxymethyl)phosphines.

Phosphonium salts of the formula: $(HOCH_2)_3P^+CH_2OH \cdot X^-$ wherein X is an anion, have been used in flame retardant finishes or have been suggested for such use.

Tetrakis(hydroxymethyl)phosphonium chloride (THPC) is a component of certain flame retardant finishes for textile materials. It is obtainable by reacting one mole of tris(hydroxymethyl)phosphine (THP), one mole of formaldehyde, and one mole of hydrochloric acid. When THPC is applied to textiles with organic nitrogenous compounds which contain trivalent nitrogen atoms bearing at least two members of the group consisting of hydrogen atoms and methylol groups, the treated textile materials have flame retardant properties which are durable to repeated laundering. The preferred nitrogenous compounds are melamine, urea and water-soluble methylol melamines and methylol ureas, as shown, for example, in U.S. Pat. No. 2,809,941. The finishes impart a stiff, "boardy" hand and cause an objectionable and sometimes severe strength loss in the treated fabric. Tensile strength, tear strength and abrasion resistance are reduced.

In U.S. Pat. Nos. 2,892,803 and 3,236,676 it is suggested that tetrakis(hydroxymethyl)phosphonium phosphate (THPP) of the formula:

$$(HOCH_2)_3P^+CH_2OH \cdot H_2PO_4^-$$

is the equivalent of THPC in flame retardant finishes containing nitrogenous compounds. Finishes containing THPP impart good flame retardancy which is durable to laundering, but the treated fabrics are stiff and boardy and suffer from unacceptable strength losses.

In U.S. Pats. Nos. 2,892,803 and 3,236,676 it is also suggested that tetrakis(hydroxymethyl)phosphonium acetate (THPA) of the formula:

$$(HOCH_2)_3P^+CH_2OH \cdot C_2H_3O_2^-$$

is the equivalent of THPC in flame retardant finishes containing nitrogenous compounds. Finishes containing THPA also impart good flame retardancy which is durable to laundering, but the acetate is considerably less stable than the corresponding chloride and phosphate salts, resulting in application problems such as inefficiency of fixation on the textile material and offensive odors.

It is an oject of the present invention to provide a storage stable, aqueous flame retardant finish for cellulosic textile materials, which is very durable to repeated launderings. It is a further object to provide a textile finish which does not appreciably change the hand and strength of the textile material to be treated. These and other objects and advantages of the present invention will become apparent from the description and examples which follow.

It has been discovered that by employing tetrakis(hydroxymethyl)phosphonium phosphate, tetrakis(hydroxymethyl)phosphonium carboxylate and urea of a urea-formaldehyde condensate with as optionalingredients: free formaldehyde and/or a melamineformaldehyde condensate, in combination provides flame retardant finishes satisfying the above objects and advantages. Unexpectedly, the results achieved through the combination of the two quaternary phosphonium salts in a textile finish produces results which are greatly superior to those obtained with the individual phosphonium salts used alone.

Of the combined phosphonium salts used in the flame retardant finish of this invention, between about 10 and about 75 mole percent, preferably between about 30 and about 70 mole percent, is tetrakis(hydroxymethyl)phosphonium phosphate, and between about 90 and about 25 mole percent, preferably between about 70 and about 30 mole percent, is tetrakis(hydroxymethyl)phosphonium carboxylate.

The finish also contains between 0.5 and 3.0 moles, preferably between 1.0 and 1.5 moles, of urea and/or urea-formaldehyde condensate per mole of combined phosphonium salts. As will be discussed below under "Drying and Curing," it is sometimes preferable to employ a urea-formaldehyde condensate instead of urea. At other times either can be used with essentially equal results.

The urea-formaldehyde condensates which may be employed include condensates of urea with up to about 3.5 moles or more of formaldehyde. Four moles is the theoretical limit. Preferably, the moles of combined formaldehyde should be between 1 and 2 per mole of urea. Mixtures of urea-formaldehyde condensates and urea can be used.

The optional free formaldehyde is used in amounts between 0 and 0.5 moles, perferably about 0.2 and 0.4 moles, per mole of combined phosphonium salts. The free formaldehyde serves to stabilize the flame retardant finishes and to improve the results obtained on cellulosic textile materials.

The optional melamine-formaldehyde condensates should be used in amounts between 0 and 1.0 moles, preferably between 0 and 0.33 moles, per mole of combined phosphonium salts. The melamine-formaldehyde condensates serve to provide supplemental nitrogen to the finish. The melamine-formaldehyde condensates which may be employed include condensates of melamine with up to 6 moles of formaldehyde (the theoretical limit). The methylol groups of the melamine-formaldehyde condensate may be partially or completely alkylated, i.e., etherified, by reaction with aliphatic alcohols.

Representative melamine-formaldehyde condensates which may be employed include dimethylol melamine, trimethylol melamine, partailly methylated trimethylol melamine, highly methylated hexamethylol melamine and blends of melamine-formaldehyde condensates with urea-formaldehyde condensates.

The aqueous solutions of tetrakis(hydroxymethyl)-phosphonium phoshpate and tetrakis(hydroxymethyl)-phosphonium carboxylate can be conveniently prepared by reacting in aqueous medium 1 mole of tris(hydroxymethyl)phosphine with at least 1 mole of formaldehyde and essentially 1 mole of combined orthophosphoric and carboxylic acid. The phosphoric acid should represent between 10 and 70 mole percent of the combined acids, the remainder is carboxylic acid. The reaction temperature should be between 20° and 100° C., preferably between 25° and 50° C.

Tris(hydroxymethyl)phosphine is a known compound. It can be prepared as described in U.S.S.R. Pat. No. 138,617, German Pat. No. 1,035,135, U.S. Pat. No. 3,030,421 or U.S. Pat. No. 3,243,450.

In a particularly advantageous procedure, tris(hydroxymethyl)phosphine and formaldehyde, as aqueous formaldehyde, are combined at the reaction temperature and orthophosphoric acid is added, followed by carboxylic acid, while maintaining the prescribed reaction temperature. The reactants can be combined as rapidly as the temperature control will allow. After the reactants are combined, the reaction temperature is maintained for a short period, for example, between 30 minutes and 2 hours, to allow completion of the formation of the quaternary phosphonium salts. The formation of the salts is rapid and, therefore, a prolonged reaction period is not required. If desired, the phosphoric acid can be combined with the tris(hydroxymethyl)-phosphine before addition of the formaldehyde, but for maximum stability of the reactant, the formaldehyde should be added before the acids. The product of the reaction is an aqueous solution of the mixed phosphonium salts. If an excess of formaldehyde is used in the preparation, the product will contain free formaldehyde. The use of some excess formaldehyde helps to ensure the existence of the product in the quaternary salt form. The presence of some free formaldehyde in the product solution serves to stabilize the composition of the product solution.

The relative proportions of tetrakis(hydroxymethyl)-phosphonium phosphate and tetrakis(hydroxymethyl)-phosphonium carboxylate is essentially the same as the proportions of phosphoric acid and carboxylic acid employed. However, due to the presence of polybasic acids, the moles of phosphonium salts formed may vary slightly from the number of moles of acid employed.

Although aqueous solutions of formaldehyde are conveniently employed, polymerized formaldehyde or paraformaldehyde can also be used.

The carboxylic acids employed in the present invention should preferably have a $K_a$ of $1.34 \times 10^{-5}$ or greater in aqueous solutions at 25° C. A variety of such suitable acids are set forth at pages 1644–5 in the Handbook of Chemistry and Physics, Chemical Rubber Publishing Co., 38th Ed. Among the preferred carboxylic acids may be mentioned acetic, glycolic, lactic, formic, propionic, butyric, valeric, oxalic and citric acid.

In a preferred process, 1.0 mole of tris(hydroxymethyl)phosphine of approximately 95% strength and 1.3 moles of formaldehyde (as 37% aqueous formaldehyde) are mixed together at a temperature of about 45°–50° C., and 0.4 moles of orthophosphoric acid (as 85% acid) is added at the same temperature, followed by 0.6 mole of acetic acid (as 99.8% acid). The temperature is maintained at 50° C. for about 1 hour, and is then lowered to below 30° C. The product is a concentrated, stable, aqueous solution of tetrakis(hydroxymethyl)phosphonium phosphate and tetrakis(hydroxymethyl)phosphonium acetate containing about 9.7% of "active phosphorus", i.e., phosphorus derived from tris(hydroxymethyl)phosphine and not from phosphoric acid. In other words, active phosphorus is phosphonium, and not phosphate, phosphorus. Other carboxylic acids are similarly used.

The flame retardant finishes of this invention are applied to cellulosic textile materials as aqueous solutions or pad baths. The solutions are prepared by diluting the above-described concentrated solution of tetrakis(hydroxymethyl)phosphonium phosphate and tetrakis( hydroxymethyl)phosphonium carboxylate with water and adding urea or a urea-formaldehyde condensate in sufficient amount to provide the number of moles prescribed above of urea and/or urea-formaldehyde condensate per mole of combined phosphonium salts. The concentration of phosphine-derived phosphorus and urea in the application solutions will depend, in general, on the method of application, the amount of phosphorus and urea to be applied to the textile material, and on the weight, structure and fiber composition of the textile material.

The amount of phosphine-derived phosphorus applied to the textile material should be between 0.5 and 5%, preferably between 2 and 3.5%, based on the weight of the material. The amount of urea, as such or in a condensate with formaldehyde, applied to the textile material should be between 2 and 10%, preferably between 4 and 8%, based on the weight of the material.

The amount of melamine-formaldehyde condensate which may optionally be used in the flame retardant finish has been set forth above. In terms of amount on the textile material, it should be between 0 and 10% based on the weight of the textile material.

The cellulosic textile materials should contain at least 20% cellulosic fibers. By cellulosic fibers it is meant such fibers as cotton, regenerated cellulose (rayon), linen, jute, etc. Blends of cellulosic fibers or blends of cellulosic fibers with noncellulosic fibers, both natural and synthetic, such as silk, wool, nylon, polyester, acrylic, etc., may be used.

The aqueous flame retardant finishes of this invention are applied to the textile material by padding, dipping, spraying, etc. The materials are then dried at a temperature between about 75° and 210° C. or higher. The drying time can range from several minutes at the lower temperature to as briefly as 15 seconds at the higher temperature. The finish is then cured at a temperature of between about 125° and 225° C., preferably between about 150° and 200° C. The time required for curing the finish is between 5 and 1 minute, depending on the temperature and the weight and structure of the textile material.

When the drying and curing operations are carried out in an oven with forced air circulation, it is advantageous to use a urea-formaldehyde condensate instead of urea in the finish.

The compositions and processes of the present invention are further described and compared with related compositions and processes by the following examples. These examples are not to be taken as being limitative of the present invention. In each case, the weights and percentages are by weight unless otherwise indicated. The ratios of phosphorus-containing components in the product solutions are approximations because orthophosphoric acid is a multivalent acid and may quaternize more than 1 mole of tris(hydroxymethyl)phosphine per mole of phosphoric acid. It is believed that it quaternizes, at most, only a small proportion of a second mole of tris(hydroxymethyl)phosphine.

EXAMPLE 1

To a reaction kettle containing 1240 g. (10.0 moles) of tris(hydroxymethyl)phosphine (about 1308 g. of 95% material) and 390 g. (13.0 moles) of formaldehyde (as 1050 g. of 37% aqueous formaldehyde) there was added, at a temperature of 45°–50° C., 392 g. (4.0 moles) of orthophosphoric acid (461 g. of 85% $H_3PO_4$), followed by 360 g. (6.0 moles) of acetic acid (361 g. of 99.8% glacial acetic acid), while at all times maintaining a temperature of 25°–50° C. The reaction mixture was stirred at 50° C. for 1 hour and then cooled to below 30° C.

The product was an aqueous solution of essentially tetrakis(hydroxymethyl)phoshonium acetate, tetrakis(hydroxymethyl)phosphonium phosphate and formaldehyde in the calculated molar ratio of 0.6/0.4/0.3. The solution contained about 9.7% active phosphorus; i.e., phosphine-derived phosphorus.

EXAMPLE 2

An aqueous pad bath was prepared containing 31.1% of a product prepared by the process of Example 1, (9.65% active phosphorus) and 9.0% of urea. The pad bath, containing 3.0% active phosphorus, was applied to cotton sheeting by a standard padding procedure, obtaining a wet pickup of 95%. The padded fabric, containing 2.85% owf of active phosphorus, was dried at 107° C. (225° F.) for 4 minutes and then cured at 163° C. (235° F.) for 4 minutes. The durability of the flame retardant finish to laundering was determined by (1) repeatedly washing the fabric in an automatic washing machine using a commercial detergent and water at 140° F., and (2) measuring the flame resistance of the dried fabric after about every 10 launderings by a vertical flame test according to standard Test Method AATCC 34—1966. The limit of practical durability on a cotton fabric is reached when the char length is 6 inches. After 100 launderings the char length was about 4.3 inches, which indicates that the flame retardancy of a finish of this invention on a 100% cotton sheeting is durable for at least 100 normal home launderings in an automatic washing machine.

EXAMPLE 3

An aqueous pad both was prepared containing 36.3% of a product prepared by the process of Example 1 (9.65% active phosphorus) and 9.0% urea. The pad bath, containing 3.5% active phosphorus, was applied to a 50/50 polyester/cotton fabric obtaining a wet pickup of 78%. The padded fabric, containing 2.73% owf of active phosphorus, was dried at 107° C. for 4 minutes and then cured at 163° C. for 4 minutes. The durability of flame retardant finish was measured by the procedure of Example 2. The practical limit of wash durability of polyester/cotton fabric is reached when the char length is about 7.0 inches. The flame retardant finish was durable for 70–80 home launderings.

EXAMPLE 4

Two aqueous pad baths were prepared of the following compositions.

TABLE I

| Pad Bath Composition | A | B |
|---|---|---|
| Product of Example 1 (9.65% active P) | 25.9% | 25.9% |
| % Active P in Bath | 2.5% | 2.5% |
| Resin A[1] | 6.0% | — |
| Resin B[2] | — | 6.0% |
| Urea | 4.0% | 9.0% |

[1]Resin A - 75% highly methylated hexamethylol melamine and 25% highly methylolated urea.
[2]Resin B - Dimethylol melamine.

The pad baths were applied to 100% cotton fabrics of various weights and structures by a standard padding procedure. The padded fabrics were dried at 107° C. for 4 minutes and cured at 163° C. for 4 minutes. The fabrics were then process washed with water at about 50° C. and dried. The durability of the finishes to laundering was determined by the procedure of Example 2.

The results, including percent wet pickup, percent active phosphorus on the fabric and durability of the finishes, are shown in Table II.

TABLE II

| Cotton Fabric | % Wet Pickup | % Active P OWF[1] | Durability - No. of Washes Pad Bath A | Pad Bath B |
|---|---|---|---|---|
| a. Poplin 96 × 40, 2.62 oz. | 79 | 1.97 | — | 85 |
| b. Print Cloth 64 × 40, 5.35 oz. | 128 | 3.21 | >100 | >100 |
| c. Print Cloth 80 × 80 | 87 | 2.17 | — | >100 |
| d. Tubular Rib Knit | 118 | 2.95 | >100 | >100 |
| e. Flannel | 114 | 2.85 | 85 | >100 |
| f. Sheeting | 99 | 2.47 | 85 | >100 |

[1]on weight of fabric

This example demonstrates that finishes of this invention provide flame retardancy on 100% cotton fabrics of various weights and structures, and that the finishes are very durable to repeated launderings.

EXAMPLE 5

An aqueous pad bath was prepared containing 31.1% of a product prepared by the process of Example 1 (9.65% active phosphorus), 6% of dimethylol melamine and 9% of urea. The pad bath, containing 3.0% active phosphorus, was applied to two fabrics of mixed cotton and polyester fibers by the procedure of Example 2. The durability of the finishes to laundering was measured by the procedure of Example 2. The results are shown in Table III.

TABLE III

| Fabric | % Wet Pickup | % Active P on Fabric | Durability No. of Washes |
|---|---|---|---|
| a. 65/35 Polyester/Cotton Print Cloth | 88 | 2.64 | 55 |
| b. 35/65 Polyester/Cotton Flannel | 104 | 3.13 | 70 |

This example demonstrates that the finishes of this invention impart durable flame retardancy to fabrics of mixed cotton and synthetic (polyester) fibers and that the fiber proportions can be varied over a wide range.

The amount of active phosphorus fixed to the fabric was determined for certain of the treated fabrics by analysis of the fabric after one laundering.

The results are shown in Table IV.

TABLE IV

| | Prod. of Ex. 1 | | Urea | | Dimethylol Melamine | | Durability | | |
|---|---|---|---|---|---|---|---|---|---|
| No. | % in Bath | % P OWF | % in Bath | % OWF | % in Bath | % OWF | No. of Washes | Alk. Hydrol. | % P on Fabric |
| a. | 25.5 | 2.5 | 0 | 0 | 2 | 2 | <10 | — | 1.70 |
| b. | " | " | " | " | 8 | 8 | <10 | — | — |
| c. | " | " | 2.5 | 2.5 | 0 | 0 | <10 | No | — |
| d. | " | " | " | " | 2 | 2 | <10 | Yes | — |
| e. | " | " | " | " | 4 | 4 | 25–40 | Yes | — |
| f. | " | " | " | " | 8 | 8 | >50 | Yes | 2.32 |
| g. | " | " | 5 | 5 | 0 | 0 | 25–40 | Yes | — |
| h. | " | " | " | " | 2 | 2 | >50 | Yes | 2.21 |
| i. | " | " | " | " | 4 | 4 | >50 | Yes | — |
| j. | " | " | 7.5 | 7.5 | 0 | 0 | >50 | No | 2.44 |
| k. | " | " | " | " | 2 | 2 | >50 | No | — |
| l. | " | " | " | " | 4 | 4 | >50 | Yes | — |
| m. | " | " | 10 | 10 | 0 | 0 | 10–20 | No | — |
| n. | 25.5 | 2.5 | 10 | 10 | 2 | 2 | 25–40 | No | — |
| o. | " | " | " | " | 4 | 4 | >50 | No | — |
| p. | " | " | " | " | 8 | 8 | >50 | Yes | 2.29 |
| q. | 30.6 | 3.0 | 2.5 | 2.5 | 0 | 0 | <10 | Yes | — |
| r. | " | " | " | " | 2 | 2 | 10–20 | Yes | — |
| s. | " | " | " | " | 4 | 4 | >50 | Yes | — |
| t. | " | " | 5 | 5 | 0 | 0 | >50 | Yes | — |
| u. | " | " | " | " | 2 | 2 | >50 | Yes | — |
| v. | " | " | 7.5 | 7.5 | 0 | 0 | >50 | Yes | — |
| w. | 35.7 | 3.5 | 0 | 0 | 2 | 2 | <10 | — | — |
| x. | " | " | " | " | 8 | 8 | <10 | — | — |
| y. | " | " | 2.5 | 2.5 | 0 | 0 | <10 | No | 1.75 |
| z. | " | " | " | " | 2 | 2 | 25–40 | Yes | — |
| aa. | " | " | " | " | 4 | 4 | >50 | Yes | — |
| bb. | " | " | 5 | 5 | 0 | 0 | >50 | Yes | — |

EXAMPLE 6

A series of aqueous pad baths was prepared containing the amounts of product prepared by the process of Example 1 (9.8% active phosphorus), urea and dimethylol melamine shown in Table IV. The pad baths also contained 0.1% of a nonionic surface active agent. The pad baths were applied to cotton sheeting (bleached, mercerized, 2.85 oz.) by a standard padding procedure obtaining a wet pickup of about 100%. The treated fabrics, containing the amount of active phosphorus, urea and dimethylol melamine shown in Table IV, were dried at 107° C. for 4 minutes and cured at 163° C. for 4 minutes.

The durability of each flame retardant finish to home laundering was determined by the procedure of Example 2.

The durability of each finish to alkaline hydrolysis, a measure of durability to commercial laundering, was determined by washing the fabric once in an automatic washing machine with water at 140° F. and a commercial detergent and then digesting the fabric for 2 hours at 95° C. in water containing 0.2% of potassium carbonate and 0.05% of a synthetic detergent. The fabric was thoroughly rinsed in water and dried. The flame resistance of the fabric was measured by the vertical flame test of Example 2.

This example demonstrates that a durable flame retardancy on cellulosic textile materials can be obtained by applying a finish containing a product prepared by the process of Example 1 and urea. It also demonstrates that urea or urea plus melamine-formaldehyde condensate must be employed in sufficient amounts for maximum durability of the finish. It also demonstrates that a certain minimum amount of active phosphorus must be fixed on the fabric for durable flame retardancy, and that the amount fixed is not only dependent on the amount of phosphorus-containing product used, but also on the amount of urea or urea plus melamine-formaldehyde condensate used.

EXAMPLE 7

Four aqueous pad baths were prepared with the compositions shown in Table V. The pad baths were applied by a standard padding procedure to cotton sheeting obtaining a wet pickup of 86%. The treated fabrics contained the amount of active phosphorus and nitrogen shown in Table V. Fabrics A and B were dried at 121° C. for 3 minutes and cured at 177° C. for 3 minutes. Fabrics C and D were dried and cured at 177° C. for 6 minutes. The drying and curing were done in ovens having forced air circulation. The durability to laundering of each flame retardant finish was determined by the procedure of Example 2. The results are shown in Table V.

TABLE V

| Pad Bath Composition | A | B | C | D |
|---|---|---|---|---|
| Product of Ex. 1 (9.8% active P) | 29.8% | 29.8% | 29.8 | 29.8% |
| Urea | 7.0% | — | 7.0% | — |
| Methylol Urea[1] (60% Solids) | — | 19.4% | — | 19.4% |
| **Treated Fabric** | **A** | **B** | **C** | **D** |
| % Active P (owf) | 2.5% | 2.5% | 2.5% | 2.5% |
| % Urea (owf) | 6.0% | — | 6.0% | — |
| % Methylol Urea[1] (owf) | — | 10.0% | — | 10.0% |

TABLE V-continued

| | | | | |
|---|---|---|---|---|
| % Nitrogen (owf) | 2.8% | 2.8% | 2.8% | 2.8% |
| Durability, No. Washes | 30 | >60 | 30 | >60 |

[1]1.3 moles combined formaldehyde per mole urea.

This example demonstrates that when the drying and curing operations are carried out in a forced air oven, better durability of the flame retardant finish is obtained by using a methylolated urea rather than urea itself. It also demonstrates that the drying and curing can be done in one operation.

EXAMPLE 8

Six pad baths were prepared with the compositions shown in Table VI. The pad baths were applied by padding to cotton sheeting obtaining an 85% wet pickup. The treated fabrics, containing 2.65% owf active phosphorus and 3.0% owf of nitrogen, were dried at 121° C. for 3 minutes and cured at 177° C. for 3 minutes in ovens having forced air circulation. The durability of each flame retardant finish was determined by the procedure of Example 2. The results are shown in Table VI.

TABLE VI

| Pad Bath Composition | A | B | C | D | E | F |
|---|---|---|---|---|---|---|
| Product of Ex. 1 (9.8% active P) | 31.7% | 31.7% | 31.7% | 31.7% | 31.7% | 31.7% |
| Urea | 7.5% | 7.5% | — | — | — | — |
| Formaldehyde (real) | — | 3.75% | — | — | — | — |
| Methylol Urea-Molar Ratio | | | | | | |
| Formaldehyde/Urea | — | 1.0 | 0.7 | 1.0 | 2.0 | 3.6 |
| Amount, solids | — | — | 10.1% | 11.2% | 15.0% | 21.0% |
| Durability, No. washes | 20 | 30 | 40 | 50 | 50 | 10 |

This example demonstrates that when the treated fabrics are dried and cured in an oven with forced air circulation, it is advantageous to employ a urea-formaldehyde condensate instead of urea, and to use a preformed condensate rather than rely on formation of the condensate in situ from urea and formaldehyde. It also demonstrates that for best results the ureaformaldehyde condensate should contain not over about 3 moles of formaldehyde per mole of urea.

EXAMPLE 9

To a mixture of 108 g. of water and 540 g. of an aqueous solution containing 470 g. (3.79 moles) of tris(hydroxymethyl)phosphine and 23 g. of formaldehyde, there was added, at a temperature below 40° C., 146 g. of 85% orthophosphoric acid (1.26 mole of $H_3PO_4$) followed by 207 g. of 44% aqueous formaldehyde (3.79 total formaldehyde). The molar ratio of tris(hydroxymethyl)phosphine/formaldehyde/phosphoric acid was 1/1/0.33. The reaction mixture was heated at 50° C. for 1 hour. The product was an aqueous solution of tris(hydroxymethyl)phosphine, formaldehyde and tetrakis(hydroxymethyl)phosphonium phosphate in the approximate molar ratio of 0.67/0.67/0.33. The solution contained 70% solids.

EXAMPLE 10

To 50 g. of the product of Example 9 there was added 6.5 g. (0.108 mole) of glacial acetic acid. The molar ratio of tris(hydroxymethyl)phosphine/formaldehyde/phosphoric acid/acetic acid was 1/1/0.33/0.57. The product was an aqueous solution of tetrakis(hydroxymethyl)phosphonium acetate, tetrakis(hydroxymethyl)phosphonium phosphate, tris(hydroxymethyl)phosphine and formaldehyde in the approximate molar ratio of 0.57/0.33/0.1/0.1. The solution contained 73.5% solids.

EXAMPLE 11

To 50 g. of product solution of Example 9 (equivalent to 0.19 mole) of tris(hydroxymethyl)phosphine, there was added 11 g. (0.11 mole) of 36% hydrochloric acid. The molar ratio of tris(hydroxymethyl)phosphine/formaldehyde/phosphoric acid/hydrochloric acid was 1/1/0.33/0.57. The product was an aqueous solution of tetrakis(hydroxymethyl) phosphonium chloride, tetrakis(hydroxymethyl)phosphonium phosphate, tris(hydroxymethyl)phosphine and formaldehyde in the approximate molar ratio of 0.57/0.33/0.10/0.10. The solution contained 64% solids.

EXAMPLE 12

Three aqueous pad baths were prepared with the compositions shown in Table VII. The percentages are on a percent by weight basis of solids.

TABLE VII

| Pad Bath Composition | A | B | C |
|---|---|---|---|
| Product of Example 9 | 15% | — | — |
| Product of Example 10 | — | 15% | — |
| Product of Example 11 | — | — | 15% |
| Resin C[1] | 9.3% | 9.3% | 9.3% |
| Urea | 9.0% | 9.0% | 9.0% |

[1]Partially methylated trimethylol melamine.

Swatches of cotton sheeting were padded with the pad baths obtaining a 95% wet pickup. The treated fabrics were dried at 107° C. for 4 minutes and cured at 163° C. for 4 minutes. The fabrics were then rinsed in warm water and dried. The durability of the finishes to laundering was determined by the procedure of Example 2.

The flame retardant finish provided by Pad Bath A was durable for over 50 washes, and the finishes provided by Pad Baths B and C were durable for over 65 washes. The hands of the fabrics treated with Pad Baths A and B were essentially the same as that of the untreated fabric, while the fabric treated with Pad Bath C was much firmer and harsher than the original fabric.

This example demonstrates that (1) the wash durability of a finish containing a major amount of tris(hydroxymethyl)phosphine and a minor amount of tetrakis(hydroxymethyl)phosphonium phosphate can be improved by converting a major portion of the tris(hydroxymethyl)phosphine to tetrakis(hydroxymethyl)phosphonium acetate or chloride, and (2) that the improved finish containing the phosphonium acetate component has little or no effect on the hand of the fabric, while the finish containing the phosphonium hydrochloride component has an unacceptable stiffening effect on the fabric.

EXAMPLE 13

A mixture of 212 g. of 91% tris(hydroxymethyl)phosphine (1.56 moles), 126 g. of 37% aqueous formaldehyde (1.56 moles) and 45 g. of water was stirred at about 20° C. for 2 hours. Glacial acetic acid (94 g., 1.56 moles) was added at a temperature below 40° C. and the mixture was stirred for 1 hour. The molar ratio of tris(hydroxymethyl)phosphine/formaldehyde/acetic acid was 1/1/1. The product was an aqueous solution of essentially tetrakis(hydroxymethyl)phosphonium acetate. The solution contained 70% solids.

EXAMPLE 14

An aqueous pad bath containing 15.7% solids of the product of Example 13 (2.5% active phosphorus in the bath), 7.9% of partially methylated trimethylol melamine and 9.0% urea was padded onto cotton sheeting obtaining a 95% wet pickup. The fabric was dried at 107° C. for 4 minutes, cured at 163° C. for 4 minutes, process washed with warm water and dried.

The flame retardant finish was durable for 40 launderings when tested by the procedure of Example 2. An odor was noted on the fabric.

This example demonstrates that a solution of tetrakis(hydroxymethyl)phosphonium acetate provides a flame retardant finish that is less durable than the products of this invention.

EXAMPLE 15

A mixture of 150 g. (1.075 mole) of 89% tris(hydroxymethyl)phosphine, 78.5 g. (1.5 moles) of 44% formaldehyde, 124.4 g. (1.075 moles) of orthophosphoric acid and 38 g. of water was stirred at a temperature below 40° C., for about 1 hour. The molar ratio of tris(hydroxymethyl)phosphine/formaldehyde/phosphoric acid was 1/1/1. The product was an aqueous solution of tetrakis(hydroxymethyl)phosphonium phosphate. The solution contained 70% solids.

EXAMPLE 16

Two aqueous pad baths were prepared. Each pad bath contained 20.3% solids (2.5% active phosphorus) of the product of Example 15, 8.7% urea and, in Pad Bath A, 9.3% dimethylol melamine or, in pad Bath B, 9.3% of partially methylated trimethylol melamine. The pad baths were padded onto cotton sheeting obtaining a 95% wet pickup. The fabrics were dried at 107° C. for 4 minutes, cured at 163° C. for 4 minutes, process washed with warm water and dried.

The flame retardant finishes were durable for at least 100 launderings when tested by the procedure of Example 2. The hand of the treated fabrics, when compared with the untreated fabric, was unsatisfactory on account of firmness and stiffness.

This example demonstrates that a solution of tetrakis(hydroxymethyl)phosphonium phosphate provides a durable flame retardant finish, but that the hand of the treated fabric is unacceptable.

EXAMPLE 17

A mixture of 13,250 g. of 91% tris(hydroxymethyl)phosphine, 8,400 g. of 37% formaldehyde, 4,530 g. of 85% orthophosphoric acid, and 1.290 g. of water was stirred at 50° C. for 1 hour. A molar ratio of tris(hydroxymethyl)phosphine/formaldehyde/phosphoric acid was 1/1/0.43. The product was an aqueous solution of tris(hydroxymethyl)phosphine, formaldehyde and tetrakis(hydroxymethyl)phosphonium phosphate in the approximate molar ratio of 0.57/0.57/0.43. The solution contained 70% solids.

EXAMPLE 18

A mixture of 2,000 g. of the product of Example 17 and 248 g. of glacial acetic acid was stirred at 50° C. for 1 hour. The molar ratio of tris(hydroxymethyl)phosphine/formaldehyde/phosphoric acid/acetic acid was 1/1/0.43/0.57. The product was an aqueous solution of tetrakis(hydroxymethyl)phosphonium acetate and tetrakis(hydroxymethyl)phosphonium phosphate in a molar ratio of approximately 0.57/0.43. The solution contained 70% solids.

EXAMPLE 19

A mixture of 500 g. of the product of Example 17 and 31 g. glacial acetic acid was stirred at 50° C. for 1 hour. The molar ratio of tris(hydroxymethyl)phosphine/formaldehyde/phosphoric acid/acetic acid was approximately 1/1/0.43/0.30. The product was an aqueous solution of tetrakis(hydroxymethyl)phosphonium acetate, tetrakis(hydroxymethyl)phosphonium phosphate, tris(hydroxymethyl)phosphine and formaldehyde in molar ratio of approximately 0.30/0.43/0.27/0.27. The solution contained 72.5% solids.

EXAMPLE 20

A mixture of 600 g. of the product of Example 17 and 18.6 g. of glacial acetic acid was stirred at 50° C. for 1 hour. The molar ratio of tris(hydroxymethyl)phosphine/formaldehyde/phosphoric acid/acetic acid was approximately 1/1/0.43/0.15. The product was an aqueous solution of tetrakis(hydroxymethyl)phosphonium acetate, tetrakis(hydroxymethyl)phosphonium phosphate, tris(hydroxymethyl)phosphine and formaldehyde in molar ratio of approximately 0.15/0.43/0.42. The solution contained 72% solids.

EXAMPLE 21

Three aqueous pad baths were prepared with the compositions shown in Table VIII. Sufficient phosphorus-containing products were used to provide about 2.5% active phosphorus on the weight of the fabric.

TABLE VIII

| Pad Bath Composition | A | B | C |
|---|---|---|---|
| Product of Example 18 | 25% | — | — |
| Product of Example 19 | — | 23% | — |
| Product of Example 20 | — | — | 23% |
| Resin B[1] | 9% | 9% | 9% |
| Urea | 9% | 9% | 9% |

[1]Dimethylolmelamine.

Swatches of cotton sheeting were padded with the pad baths obtaining a 95% wet pickup. The treated fabrics were dried at 107° C. for 4 minutes and cured at 163° C. for 4 minutes. The fabrics were rinsed in warm water and dried.

The durability of the finishes to laundering was determined by a vigorous test procedure consisting of repeatedly washing the treated fabrics in a standard Najort washing machine using water at 200° F., soda ash, soap and a synthetic detergent. After 6 washings, the flame resistance of each fabric was measured by the procedure of Example 2. The char length of Fabrics A, B and C were 3.0. 4.3 and 2.7 inches, respectively. For comparison, the flame retardancy of the fabric treated with Pad Bath A was durable for at least 65 washings by the washing procedure of Example 2.

This example demonstrates the essentially equal flame retardancy obtained by use of products containing equal amounts of tetrakis(hydroxymethyl)phosphonium phosphate and varying amounts of tetrakis(-hydroxymethyl)phosphonium acetate.

EXAMPLE 22

Four samples, A, B, C and D, of aqueous flame retardants of approximately the same solids content were stored in gas collection tubes at 50° C. The molar ratios of tris(hydroxymethyl)phosphine/formaldehyde/phosphoric acid/acetic acid used in preparing the samples are shown in Table IX.

TABLE IX

| | Molar Ratios | | | |
|---|---|---|---|---|
| Compositions | THP | HCHO | $H_3PO_4$ | $CH_3COOH$ |
| Sample A | 1 | 1 | 0.4 | — |
| Sample B | 1 | 1 | 0.43 | 0.15 |
| Sample C | 1 | 1 | 0.43 | 0.3 |
| Sample D | 1 | 1 | 0.4 | 0.6 |

The volume of gas liberated by each sample was measured at intervals of time. In the appended figure, the volume of gas is plotted against total elapsed time.

This example demonstrates the relatively greater stability of product solutions of this invention (Sample D) versus similar solutions (Samples A–C) prepared with less, or no, acetic acid. It also shows the progressive increase in stability as the amount of acetic acid is increased and the amount of unquaternized tris(hydroxymethyl)phosphine is decreased.

EXAMPLE 23

The general procedure of Example 22 was followed using two products, A and B, prepared with tris(hydroxymethyl)phosphine/formaldehyde/phosphoric acid/acetic acid molar ratios of 1/1/0.33/0.66 and 1/1/0.33/0.33, respectively. The results are shown in Table X.

TABLE X

| | Volume (ml) of Gas | |
|---|---|---|
| Total Hours | A | B |
| 4 | 0 | 3 |
| 7 | 0 | 6 |
| 23 | 0 | 17 |
| 28 | 0 | 22 |
| 31 | 0.12 | 25 |
| 47 | 1 | 35 |

This example again demonstrates the greater stability of a product having no unquaternized tris(hydroxymethyl)phosphine versus one containing unquaternized tris(hydroxymethyl)phosphine.

EXAMPLE 24

To a reaction vessel, containing tris(hydroxymethyl)-phosphine (65 g., 0.5 mole as a 95% pure composition) and formaldehyde (41.6 g., 0.625 mole as a 45% aqueous solution) there was added, at a temperature of 45°–50° C., 85% orthophosphoric acid (23 g., 0.2 mole), glacial acetic acid (18 g., 0.3 mole) and water (24.4 g.).

After the addition, the mixture was heated at 50° C. for 2 hours to effect formation of the desired salt mixture, namely, tetrakis(hydroxymethyl)phosphonium phosphate and acetate. The solution contained about 9% active phosphorus from the THP.

EXAMPLE 25

The procedure of Example 24 was repeated using 70% glycolic acid (32.5 g., 0.3 mole) and 10 g. of water in lieu of the glacial acetic acid and 24.4 g. sample of water used therein.

The desired product, containing a mixture of the tetrakis(hydroxymethyl)phosphonium phosphate and glycolate salts and a 9% active phosphorus content from THP was produced.

EXAMPLE 26

The procedure of Example 24 was repeated using 85% lactic acid (31.8 g., 0.3 mole) and 10.6 g. of water in lieu of the glacial acetic acid and 24.4 g. sample of water used therein.

The desired product, containing a mixture of the tetrakis(hydroxymethyl)phosphonium phosphate and lactate salts was produced.

The solution contained about 9% active phosphorus from the THP.

EXAMPLE 27

The procedure of Example 24 was repeated using malic acid (40 g., 0.3 mole) in lieu of the glacial acetic acid used therein.

The desired product, containing a mixture of the tetrakis(hydroxymethyl)phosphonium phosphate and malate salts was produced.

The solution contained about 8.1% active phosphorus from the THP.

EXAMPLE 28

The procedure of Example 24 was repeated using the monohydrate of citric acid (31.5 g., 0.15 mole) and 10.9 g. of water in lieu of the glacial acetic acid and 24.4 g. sample of water used therein.

The desired product, containing a mixture of the tetrakis(hydroxymethyl)phosphonium phosphate and citrate salts was produced.

The solution contained about 9% active phosphorus from the THP.

EXAMPLES 29–33

Five pad baths were prepared using the compositions of Examples 24–28, labeled A through E, respectively. The pad bath compositions are in each case set forth in Table XI below.The baths were applied to cotton sheeting by padding, obtaining an 85% wet pickup.

The treated fabrics were dried at 107° C. for 4 minutes and cured at 163° C. for 4 minutes in ovens having forced air circulation.

The durability of each flame retardant finish to laundering was determined by the procedure of Example 2. The results achieved are set forth in Table XII below.

TABLE XI

| Ex. | Phosphonium Salts | | Urea | Surfactant[a] | |
|---|---|---|---|---|---|
| No. | Type | % | % | % | pH |
| 29 | A | 27.8 | 6.0 | 0.1 | 4.95 |
| 30 | B | 27.8 | 6.0 | 0.1 | 4.55 |

TABLE XI-continued

| Ex. No. | Phosphonium Salts Type | Phosphonium Salts % | Urea % | Surfactant[a] % | pH |
|---|---|---|---|---|---|
| 31 | C | 27.8 | 6.0 | 0.1 | 4.65 |
| 32 | D | 30.9 | 6.0 | 0.1 | 3.8 |
| 33 | E | 27.8 | 6.0 | 0.1 | 4.4 |

[a]Decereasol Surfactant NI Conc., a polyethoxy alkylphenol non-ionic surface active agent by the American Cyanamid Co.

TABLE XII

| Ex. No. | Char Length (inches) v. No. of Washed (W) 10W | 25W | 40W | 50W | 60W | 70W | 80W | 100W |
|---|---|---|---|---|---|---|---|---|
| 29 | 4.7 | 4.0 | 5.0 | 4.5 | 5.1 | 6.2 | 5.1 | 5.5 |
| 30 | 4.3 | 4.8 | 5.0 | 5.2 | 5.0 | 5.5 | 5.1 | 5.3 |
| 31 | 4.4 | 4.5 | 5.5 | 4.6 | 5.2 | 4.9 | 5.0 | 5.0 |
| 32 | 4.5 | 4.9 | 5.2 | 5.7 | 5.3 | 5.2 | 8.3 | 5.2 |
| 33 | 5.0 | 5.4 | 8.7 | 6.6 | 5.3 | 5.7 | 5.6 | 5.4 |

We claim:

1. An aqueous flame retardant finish composition for cellulosic textile materials comprising tetrakis(hydroxymethyl)phosphonium phosphate, tetrakis(hydroxymethyl)phosphonium carboxylate, and urea of a urea-formaldehyde condensate, or both.

2. A composition according to claim 1 having between 10 and 75 mole percent of tetrakis(hydroxymethyl)phosphonium phosphate and between 90 and 25 mole percent of tetrakis(hydroxymethyul)phosphonium carboxylate, and between 0.5 and 3.0 moles of urea or urea-formaldehyde condensate per mole of the combined phosphonium salt.

3. A composition according to claim 1 containing between 0 and 0.5 mole of free formaldehyde per mole of combined phosphonium salt.

4. A composition according to claim 1 containing between 0 and 1 mole of melamine-formaldehyde condensate per mole of combined phosphonium salt.

5. A composition according to claim 1 where the tetrakis(hydroxymethyl)phosphonium carboxylate is selected from the group consisting of tetrakis(hydroxymethyl)phosphonium acetate, lactate, glycolate, malate olate and citrate.

6. A composition according to claim 1 wherein the aqueous solution contains between 10 and 75 moles percent of tetrakis(hydroxymethyl)phosphonium phosphate and between 90 and 25 mole percent of tetrakis(hydroxymethyl)phosphonium carboxylate.

* * * * *